US005555606A

United States Patent [19]

Chu

[11] Patent Number: 5,555,606

[45] Date of Patent: Sep. 17, 1996

[54] PAPER FASTENER

[75] Inventor: Cornel Chu, London, England

[73] Assignee: Hi-Tech Industries Limited, London, England

[21] Appl. No.: 343,515

[22] PCT Filed: Jun. 2, 1993

[86] PCT No.: PCT/GB93/01168

§ 371 Date: Dec. 5, 1994

§ 102(e) Date: Dec. 5, 1994

[87] PCT Pub. No.: WO93/25394

PCT Pub. Date: Dec. 23, 1993

[30] Foreign Application Priority Data

Jun. 9, 1992 [GB] United Kingdom ..... 9212149

[51] Int. Cl.[6] ..... B42F 1/00; B42F 21/00

[52] U.S. Cl. ..... 24/67.9; 24/545; 24/563

[58] Field of Search ..... 24/67.9, 67 R, 24/545, 546, 563, 342, 385; 40/641

[56] References Cited

U.S. PATENT DOCUMENTS

| | | | |
|---|---|---|---|
| D. 206,786 | 1/1967 | McCormick . | |
| D. 225,906 | 1/1973 | Cline . | |
| 273,301 | 3/1883 | Page et al. . | |
| 915,073 | 3/1909 | Chapin . | |
| 1,557,550 | 10/1925 | Benson . | |
| 1,897,755 | 2/1933 | Greene | 40/641 |
| 2,543,144 | 2/1951 | Wold | 24/153 |
| 3,023,474 | 3/1962 | Shears | 24/259 |
| 3,296,673 | 1/1967 | Kirkpatrick | 24/67 R |
| 3,797,076 | 3/1974 | Watkin | 24/67.9 |
| 4,255,837 | 3/1981 | Holtz | 24/243 |
| 4,332,060 | 6/1982 | Sato | 24/67.9 |
| 4,506,416 | 3/1985 | Ohminato et al. | 24/67 |
| 4,524,992 | 6/1985 | Linn | 281/45 |
| 4,563,796 | 1/1986 | Kettlestrings | 24/563 |
| 4,634,429 | 1/1987 | Schoettley | 24/563 |
| 4,706,342 | 11/1987 | Yu | 24/67 |
| 4,928,361 | 5/1990 | Brown | 24/67 |
| 4,946,065 | 8/1990 | Goulter et al. | 24/545 |
| 4,991,269 | 2/1991 | Kuroda | 24/67 |

FOREIGN PATENT DOCUMENTS

| | | | |
|---|---|---|---|
| 8707223 | 12/1987 | European Pat. Off. . | |
| 9116209 | 10/1991 | European Pat. Off. . | |
| 1527581 | 5/1968 | France . | |
| 2403414 | 4/1979 | France . | |
| 2627434 | 8/1989 | France . | |
| 140336 | 3/1902 | Germany . | |
| 0140336 | 5/1903 | Germany | 24/545 |
| 1246673 | 8/1967 | Germany . | |
| 9016636 | 4/1992 | Germany . | |
| 9301246 | 3/1993 | Germany . | |
| 282746 | 8/1952 | Switzerland . | |
| 407049 | 8/1966 | Switzerland . | |
| 22195 | 12/1915 | United Kingdom . | |
| 157520 | 2/1921 | United Kingdom . | |
| 2206922 | 1/1989 | United Kingdom . | |

*Primary Examiner*—Victor N. Sakran

*Attorney, Agent, or Firm*—Armstrong, Westerman, Hattori, McLeland & Naughton

[57] ABSTRACT

A paper fastener for holding one or more sheets of paper without penetrating or damaging the paper comprises a generally channel-sectioned component having a base and opposed upper and lower arms between which the paper is received. The lower arm forms a support surface for the paper while the upper arm serves as or is provided with a gripping member to engage paper received between the arms and to bias the paper against the lower arm. At one end of the fastener the arms diverge away from each other to define an open mouth which facilitates the introduction of paper into the fastener.

14 Claims, 3 Drawing Sheets

PAPER FASTENER

THE PRESENT INVENTION relates to a paper fastener and more particularly to a paper fastener which may be used to hold one sheet of paper or to join together several sheets of paper without penetrating or damaging the paper.

Previously proposed paper fasteners for joining together several sheets of paper without penetrating or damaging the paper have included paper clips formed from a folded length of wire. These conventional paper clips are provided in several different sizes since any one size of, clip is only capable of holding a limited number of sheets of paper within a relatively narrow range. It is often desirable to label bundles of paper, which are held together by means of paper clips and, unless the separate bundles are placed in folders, files or the like there is no simple way of marking the various bundles so that the label or marking is readily visible when several bundles or paper are stacked on top of each other.

One example of a clip, which is intended for use to secure together a bundle of cheques in a cheque book, is shown in U.S. Pat. No. 3,023,474. This document shows an elongate clip having a base and a pair of legs between which a channel is formed. One of the legs is of greater overall dimension than the other so as to project beyond the edges thereof in order to permit mounting of that leg on a cover of a cheque book. Whilst the free edges of one of the arms are bent slightly outwardly, the channel defined by the clip is of substantially cross-section and the insertion of a bundle of cheques into the clip necessitates that the arms be forced apart. This can be an awkward operation to effect whilst simultaneously trying to insert the paper between the arms.

A further design of this type of clip is shown in GB 2206922A. The clip shown in this document is an integrally moulded plastics component. The clip again defines a channel between two arms which are interconnected by an arcuate portion 12. One of the arms has cut-away portions adjacent its ends which serve, to some degree, to facilitate the insertion of paper into the clip. Whilst these cut-away portions have edges which are upturned so as to define "wing portions", again the clip is of substantially constant cross-section over its length and it would still be a relatively awkward task to introduce a bundle of papers into the clip. In addition a separate tab component has to be provided with the clip in order to carry information.

Another document which discloses clips of this general type is French Specification 1527581. This document shows a variety of extrusions of constant cross-section which each have a pair of arms which must be prized apart in order to insert paper therebetween. The designs shown in this Specification again suffer from the disadvantages mentioned above insofar as the need to prize the arms of the clip apart is concerned in order to insert paper therebetween.

It is also known to hold several sheets of paper together by means of a so-called bulldog clip comprising a channel-like member formed of a spring metal, together with a pair of handles which are mounted on the spring metal channel and which are used in order to prize apart the arms of the channel to allow for the insertion of paper. These type of clips comprise three separate components and thus production and assembly of the clips is relatively expensive as compared with conventional paper clips described above. In addition the spring metal forming the main component of the clip is usually very still and inserting papers into the clip is often a difficult and awkward operation, particularly for anyone suffering from a slight weakness of the hands.

The present invention seeks to provide an improved paper fastener which addresses the problems discussed above.

One aspect of this invention provides a paper fastener comprising a generally channel-sectioned component having a base and first and second opposed arms between which an elongate channel is defined, the base of the channel-section having a substantially planar outer surface which provides a region adapted to be written upon, one of the opposed arms forming a supporting surface for the paper and the other arm serving as a gripping member which engages paper received within the channel-section between the arms and biasses the paper against the opposed arm, the arms of the channel-sectioned fastener diverging away from each other in a direction towards one end of the channel-section such that the elongate channel is of a different, greater cross-sectional area at said one end, the diverging arms extending substantially parallel with each other in cross-section at said one end and forming an open mouth which facilitates the introduction of paper into the fastener, the first arm projecting beyond the second arm at the end of the fastener provided with the open mouth, the projecting portion of the first arm forming a platform upon which the edge of one or more sheets of paper is supported when the paper is to be inserted into the fastener.

Preferably the free edges of the opposed arms engage each other when the fastener is not in use.

Advantageously the base and the first arm of the generally channel-sectioned component extend at right angles to each other in cross-section and the second arm extends from an edge of the base in a direction towards the free edge of the first arm.

Preferably the second arm extends downwardly from an uppermost edge of the base to engage the upper surface of the first arm.

Conveniently the inwardly directed surface of the second arm carries an inwardly directed tooth which engages the inwardly directed surface of the first arm.

Advantageously the inwardly directed surface of the first arm carries one or more teeth or ridges, the teeth or ridges being formed at that point on the first arm which is engaged by the tooth formed on the lower surface of the second arm.

Preferably the open mouth at one end of the fastener is defined between the first and second arms, the free edge of the second arm extending from a position adjacent the free edge of the first arm up to the level of the uppermost edge of the base and then extending substantially parallel to the first arm to connect with the uppermost edge of the base.

Preferably the base and part of one arm of the channel-sectioned component each define a planar outer surface which provides a region adapted to be written upon.

Conveniently the base and part of both arms of the channel-sectioned component each define a planar outer surface which provides a region adapted to be written upon. Preferably the base or part of one arm of the channel-sectioned component defines said planar outer surface which provides an indexing region adapted to be written upon or to carry a label.

In order that the present invention may be more readily understood and so that further features thereof may be appreciated, the invention will now be described by way of example, with reference to the accompanying drawings in which.

Figure 1:
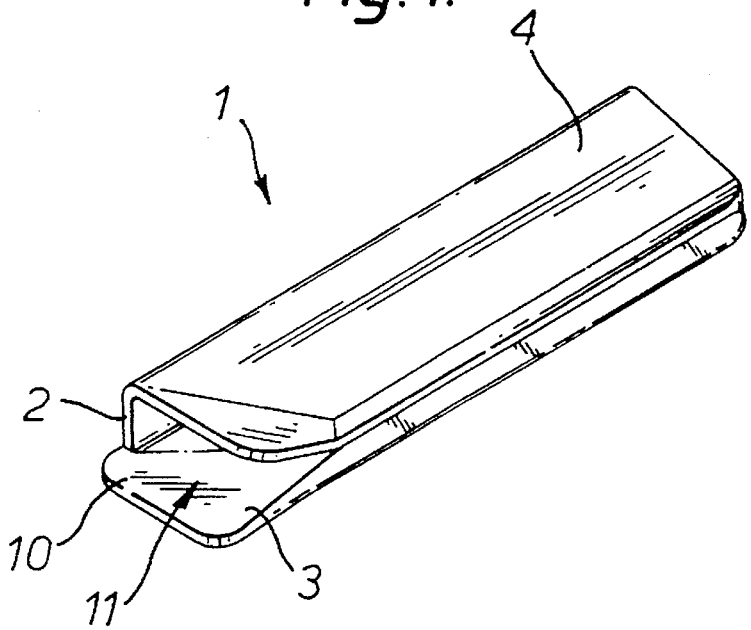
FIG. 1 is a perspective view from the front showing a first embodiment of paper fastener in accordance with this invention.
Figure 2:
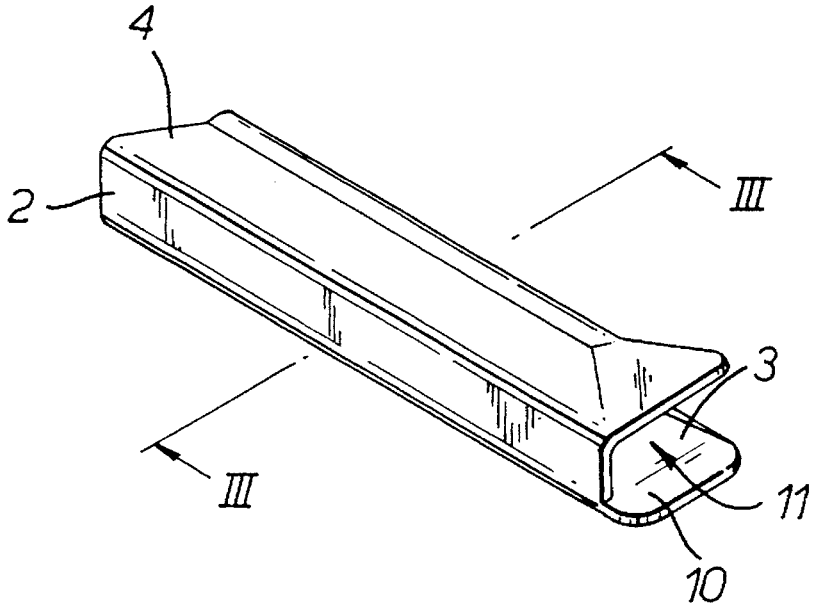
FIG. 2 is a perspective view from the rear showing the fastener of FIG. 1.

Referring initially to the first embodiment of paper fastener shown in FIGS. 1 to 5 of the accompanying drawings, the fastener comprises a generally channel-like, integrally moulded plastics component 1 having a base 2 and a pair of opposed arms, there being a lower arm 3 and a upper arm 4. The fastener is elongate, having an overall length of approximately 50 mm and a depth measured from the exterior of the base 2 to the free edges of the lower and upper arms of approximately 16 mm. The height of the base 2 i.e. the distance between the lower and upper arms at the base 2, is approximately 9 mm. The wall thickness of the base and the lower and upper arms may be approximately 1 mm.

Figure 3:
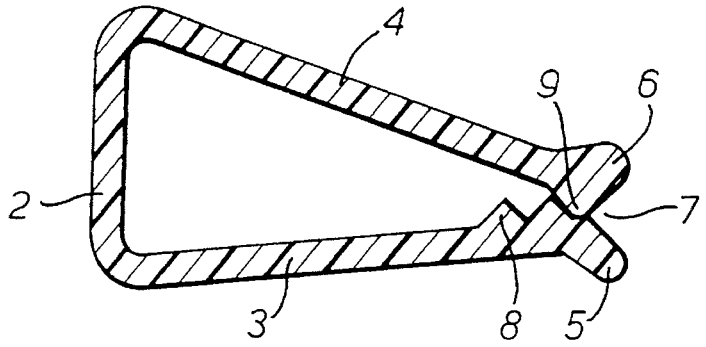
FIG. 3 is a cross-sectional view taken on the line III—III of FIG. 2.
Figure 4:
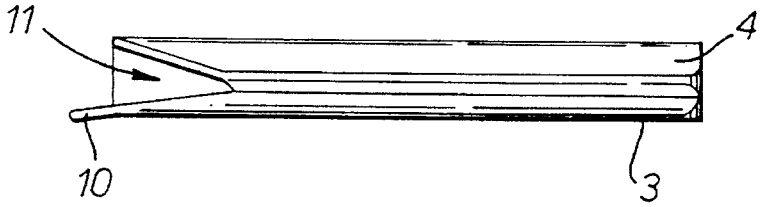
FIG. 4 is a front elevation of the fastener of FIGS. 1 to 3.

As can clearly be seen in FIG. 3 of the drawings, the base 2 and the arms 3, 4 are substantially planar. The base 2 and the lower arm 3 stand at right angles to each other, whilst the upper arm 4 extends from the uppermost edge of the base 2 down towards the free edge of the lower arm 3. The free edge of the lower arm 3 is slightly inclined in a downwards direction, as identified at 5 in FIG. 3, whilts the free edge of the upper arm 4 is formed as an upturned lip 6, so that a generally V-shaped entrance 7 is defined between the free edges of the arms 3, 4. The upper surface of the lower arm 3 defines a number of small teeth or ridges 8 which extend along the length of the arm at a position just behind the downturned portion 5, whilst the underside of the upper arm 4 defines a downwardly directed tooth 9 at its lowermost point, the tooth running along the length of the arm and engaging the teeth or ridges 8 formed on the upper surface of the lower arm 3 when the fastener is in a relaxed condition as shown in FIG. 3 i.e. when it is not holding paper. At one end of the fastener the lower arm 3 has a portion 10 which projects beyond the end of the base 2 and the extent of the upper arm 4, this projecting portion 10 serving as a small platform upon which papers are placed when they are to be inserted into the fastener, as will be described in more detail hereinafter. At the same end as is formed with the projecting platform 10, the fastener defines an open mouth 11 between the lower and upper arms 3, 4. Thus, at this end of the fastener (the left hand end as seen in FIG. 4 of the drawings), the free edge of the upper arm 4 is swept upwardly so that it extends from its position adjacent the free edge of the lower arm 3 to be at approximately the same height as the upper edge of the base 2 before extending rearwardly to connect with the upper edge of the base.

Figure 5:
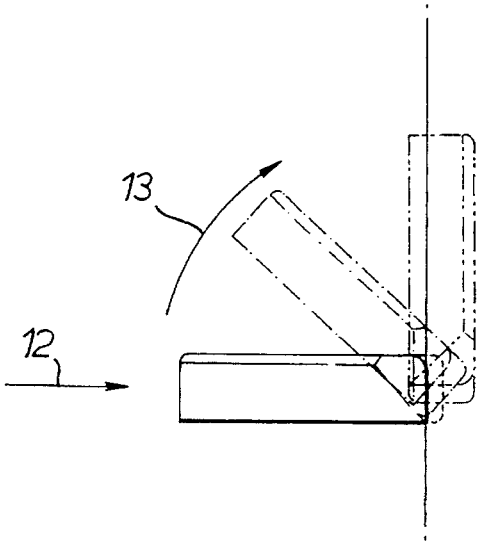
FIG. 5 is a view showing how the fastener of FIGS. 1 to 4 is applied to one or more sheets of paper.

When using the fastener to hold one or more sheets of paper the edge of the paper which is to be received within the channel of the fastener is initially positioned on the short projecting platform 10 so that the longitudinal axis of the fastener is at right angles to the edge of the paper in the manner as shown by arrow 12 in FIG. 5 of the drawings. The edge of the paper is now located immediately adjacent the open mouth 11 at the end of the fastener. The fastener is now swung through an angle of 90° about its end having the open mouth 11, in the manner as shown by the arrow 13 in FIG. 5, so that the edge of the paper passes into the open mouth 11 and is then gradually guided into the entrance 7 between the free edges of the lower arm 3 and the upper arm 4 until it is fully received within the channel defined between the arms. It is to be appreciated that the fastener is formed from a material having a significant degree of inherent resilience so that the arms 3, 4 are forced apart as the paper is guided therebetween and then serve to grip the paper, with the teeth or ridges 8 and the tooth 9 assisting in positively gripping the paper. The fastener is designed to be capable of holding any number of sheets of paper between 1 and 50. It is envisaged that the fastener will be formed from a polycarbonate material, although other materials, including non-plastics materials could also be used if desired.

It will be appreciated that the production costs for a fastener of the type described above are minimal since it could be produced as a single plastics moulding. This would also enable the fastener to be produced in a range of colours. Another important advantage of this particular design of fastener is that the planar outer surfaces of the base 2 and the lower arm 3 and the upper arm 4 can all be used for indexing purposes. Thus, these outwardly directed surfaces may carry labels or may be written on directly. These surfaces are slightly roughened or provided with formations so that they are not totally smooth. This makes the surface suitable for being written upon and helps to prevent writing on the surface from being accidentally wiped therefrom. This "write-on" facility enables several bundles of paper which are held in fasteners of the type described to be stored on top of each other with the markings on the exterior of the base 2 still being visible and providing an immediate indication of the subject matter of the papers held in the fastener.

It will be seen that introducing the papers into the fastener is made very simple by the provision of the projecting platform 10 and the open mouth 11 at one end of the fastener, with these features eliminating the need to prize the arms 3, 4 apart in order to insert paper into the fastener. Paper may be removed from the fastener either by sliding the fastener along the edge of the paper and removing it at one end of the paper or by raising the upper arm 4 slightly relative go the lower arm 3 by applying a light upwardly directed force to the upwardly swept end of the upper arm adjacent the mouth 11, whereupon the papers may be removed from between the arms.

Figure 6:
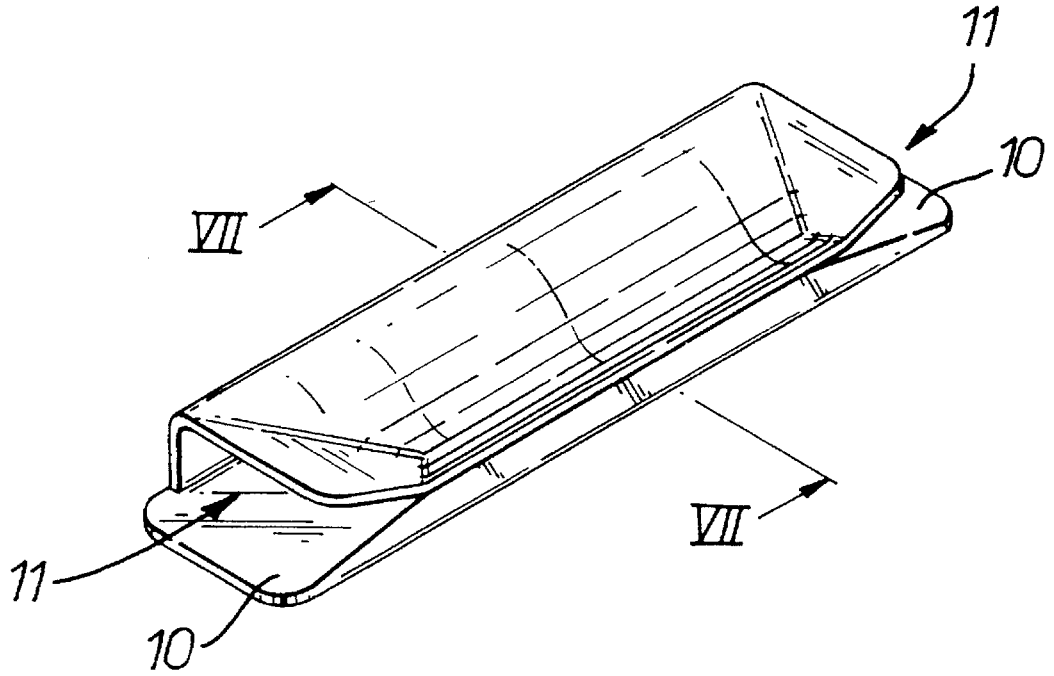
FIG. 6 is a front perspective view of a second embodiment of paper fastener in accordance with this invention.
Figure 7:
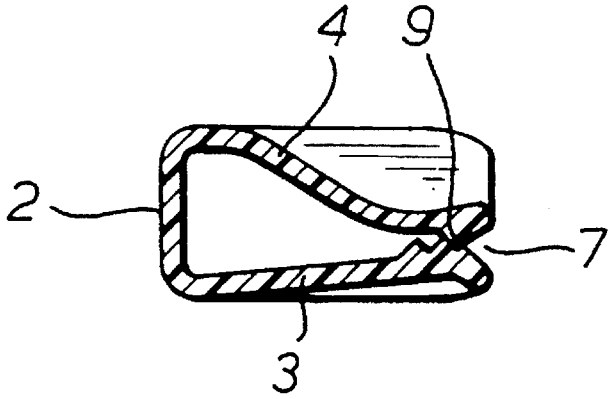
FIG. 7 is a cross-sectional view taken on the line VII—VII of FIG. 6.

FIGS. 6 and 7 illustrate a slightly modified embodiment of the fastener and for ease of description the same reference numerals are used for features which are common to the embodiment of FIGS. 1 to 5 and the embodiment of FIGS. 6 and 7.

In this second embodiment the fastener again has a base 2, a lower arm 3 and an upper arm 4. A generally V-shaped entrance 7 is defined between the free edges of the upper and lower arms. In contrast to the embodiment of FIGS. 1 to 5, the upper arm 4 of this second embodiment is of arcuate form as can clearly be seen in FIG. 7. The upper arm 4 again defines a downwardly directed tooth 9 which engages the upper surface of the lower arm 3. If desired the lower arm 3 may again define a series of upwardly directed teeth or ridges 8.

The main difference between the embodiment of FIGS. 1 to 5 and that of FIGS. 6 and 7 is that the fastener defines a small projecting platform 10 and an open mouth 11 at both of its ends. Thus, papers may be inserted into the fastener from either end. In all other regards this second embodiment of fastener is the same as that previously described.

The outer surfaces of the base 2, the lower arm 3 and the upper arm 4 again slightly toughened so that they are not entirely smooth and provide indexing areas which can be written on to identify the subject matter of the papers held in the fastener.

Whilst the primary use of the paper fastener is to interconnect sheets of paper, it may be used for other purposes. Thus, the fastener could be clipped over one edge of a suspension file in order to provide an indexing facility or could be used to interconnect two files.

It should be appreciated that various modifications may be made to the embodiments described above without departing from the scope of the present invention. Thus, whilst it is envisaged that the fastener may be produced as a single injection moulding, the fastener could be formed from materials other than plastics if desired.

We claim:

1. A paper fastener comprising a generally channel-sectioned component (1) having a base (2) and first and second opposed arms (3,4) between which an elongate channel is defined, the base (2) of the channel-section having a substantially planar outer surface which provides a region adapted to be written upon, one of the opposed arms (3) forming a supporting surface for the paper and the other arm (4) serving as a gripping member which engages paper received within the channel-section between the arms (3,4) and biases the paper against the opposed arm (3), the arms (3,4) of the channel-sectioned fastener diverging away from each other in a direction towards one end of the channel-section such that the elongate channel is of a different, greater cross-sectional area at said one end, the diverging arms (3,4) extending substantially parallel with each other in cross-section at said one end and forming an open mouth (11) which facilitates the introduction of paper into the fastener, the first arm (3) projecting beyond the second arm (4) at the end of the fastener provided with the open mouth (11), the projecting portion (10) of the first arm (3) forming a platform upon which the edge of one or more sheets of paper is supported when the paper is to be inserted into the fastener.

2. A paper fastener according to claim 1, wherein the free edges of the opposed arms (3,4) engage each other when the fastener is not in use.

3. A paper fastener according to claim 1, wherein the base (2) and the first arm (3) of the generally channel-sectioned component (1) extend at right angles to each other in cross-section and the second arm (4) extends from an edge of the base (2) in a direction towards the free edge of the first arm (3).

4. A paper fastener according to claim 3, wherein the second arm (4) extends downwardly from an uppermost edge of the base (2) to engage the upper surface of the first arm (3).

5. A paper fastener according to claim 4, wherein the inwardly directed surface of the second arm (4) carries an inwardly directed tooth (9) which engages the inwardly directed surface of the first arm (3).

6. A paper fastener according to claim 5, wherein the inwardly directed surface of the first arm (3) carries one or more teeth or ridges (8), the teeth or ridges (8) being formed at that point on the first arm (3) which is engaged by the tooth (9) formed on the lower surface of the second arm (4).

7. A paper fastener according to claim 1, wherein the open mouth (11) at one end of the fastener is defined between the first and second arms (3,4), the free edge of the second arm (4) extending from a position adjacent the free edge of the first arm (3) up to the level of the uppermost edge of the base (2) and then extending substantially parallel to the first arm (3) to connect with the uppermost edge of the base (2).

8. A paper fastener according to claim 1, wherein the base (2) and part of one arm (4) of the channel-sectioned component (1) each define a planar outer surface which provides a region adapted to be written upon.

9. A paper fastener according to claim 8, wherein the base (2) and part of both arms (3,4) of the channel-sectioned component (1) each define a planar outer surface which provides a region adapted to be written upon.

10. A paper fastener comprising a generally channel-sectioned component (1) having a base (2) and first (3) and second (4) opposed arms between which an elongate channel is defined, the first (3) and second (4) arms having respective free edges which engage each other when the fastener is not in use, the base (2) of the channel-section having a substantially planar outer surface which provides a region adapted to be written upon, one of the opposed arms forming a supporting surface for the paper and the other arm serving as a gripping member which engages paper received within the channel-section between the opposed arms and biases the paper against the opposed arm, the arms (3, 4) of the channel-sectioned fastener diverging away from each other in a direction towards one end of the channel-section such that the elongate channel is of a different, greater cross-sectional area at said one end, the diverging arms (3, 4) extending substantially parallel with each other in cross-section at said one end and forming an open mouth (11), the parallel orientation of the arms in cross-section at said one end of the channel-section preventing the fastener from gripping paper at said one end as paper is inserted into the open mouth (11) and thereby facilitating the introduction of paper into the fastener, the first arm (3) projecting beyond the second arm (4) at the end of the fastener provided with the open mouth (11), the projecting portion of the first arm (3) forming a platform (10) upon which the edge of one or more sheets of paper is supported when the paper is to be inserted into the fastener.

11. A paper fastener comprising a generally channel-sectioned component (1) having a base (2) and first (3) and second (4) opposed arms between which an elongate channel is defined, the first (3) and second (4) arms having respective free edges which engage each other when the fastener is not in use, the base (2) of the channel-section having a substantially planar outer surface which provides a region adapted to be written upon, one of the opposed arms forming a supporting surface for the paper and the other arm serving as a gripping member which engages paper received within the channel-section between the opposed arms and biases the paper against the opposed arm, the arms (3, 4) of the channel-sectioned fastener diverging away from each other in a direction towards one end of the channel-section such that the elongate channel is of a different, greater cross-sectional area at said one end, the diverging arms (3, 4) extending substantially parallel with each other in cross-section at said one end and forming an open mouth (11), the parallel orientation of the arms in cross-section at said one end of the channel-section preventing the fastener from gripping paper at said one end as paper is inserted into the open mouth (11) and thereby facilitating the introduction of paper into the fastener, the first arm (3) projecting beyond the second arm (4) at the end of the fastener provided with the open mouth (11), the projecting portion of the first arm (3) forming a platform (10) upon which the edge of one or more sheets of paper is supported when the paper is to be inserted into the fastener, the paper being inserted into the fastener by positioning an edge of the paper on the platform (10) formed by the projecting portion of the first arm (3) adjacent the open mouth (11) with the edge of the paper extending substantially at right angles to the longitudinal axis of the elongate channel defined between the first and second arms (3, 4) of the paper fastener and then rotating the fastener through an angle of approximately 90° degrees about said one end which defines the open mouth (11) so that the edge of the paper passes into the open mouth (11) and is then gradually guided between the free edges of the first and second opposed arms (3, 4) until it is fully received within the channel defined between the first and second opposed arms.

12. A paper fastener comprising a generally channel-sectioned component (1) having a base (2) and first (3) and second (4) opposed arms between which an elongate channel is defined, the first (3) and second (4) arms having respective free edges which engage each other when the fastener is not in use, the base (2) of the channel section having a substantially planar outer surface which provides a region adapted to be written upon, one of the opposed arms forming a supporting surface for the paper and the other arm serving as a gripping member which engages paper received within the channel-section between the opposed arms (3, 4) and biases the paper against the opposed arm, the first (3) and second (4) opposed arms having respective inwardly directed surfaces, the inwardly directed surface of the second arm (4) carrying an inwardly directed tooth (9) and the inwardly directed surface of the first arm (3) carrying one or more teeth or ridges (8), the teeth or ridges (8) being formed at that point on the first arm (3) which is engaged by the second arm (4) such that the tooth (9) formed on the inwardly directed surface of the second arm (4) engages with the teeth or ridges (8) formed on the inwardly directed surface of the first arm (3), the arms (3, 4) of the channel-sectioned fastener diverging away from each other in a direction towards one end of the channel-section such that the elongate channel is of a different, greater cross-sectional area at said one end, the diverging arms extending substantially parallel with each other in cross-section at said one end and forming an open mouth (11), the parallel orientation of the arms in cross-section at said one end of the channel-section preventing the fastener from gripping paper at said one end as paper is inserted into the open mouth (11) and thereby facilitating the introduction of paper into the fastener, the first arm (3) projecting beyond the second arm (4) at the end of the fastener provided with the open mouth (11), the projecting portion of the first arm (3) forming a platform (10) upon which the edge of one or more sheets of paper is supported when the paper is to be inserted into the fastener.

13. A paper fastener comprising a generally channel-sectioned component (1) having a base (2) and first (3) and second (4) opposed arms between which an elongate channel is defined, the first and second arms (3, 4) having respective free edges which engage each other when the fastener is not in use, the base (2) of the channel-section and part of at least one arm each have a substantially planar outer surface which provides a region adapted to be written upon, one of the opposed arms (3, 4) forming a supporting surface for the paper and the other arm serving as a gripping member which engages paper received within the channel-section between the opposed arms and biases the paper against the opposed arm, the first (3) and second (4) opposed arms having respective inwardly directed surfaces, the inwardly directed surface of the second arm (4) carrying an inwardly directed tooth (9) and the inwardly directed surface of the first arm (3) carrying one or more teeth or ridges (8), the teeth or ridges (8) being formed at that point on the first arm (3) which is engaged by the second arm (4) such that the tooth (9) formed on the inwardly directed surface of the second arm (4) engages with the teeth or ridges (8) formed on the inwardly directed surface of the first arm (3), the arms (3, 4) of the channel-sectioned fastener diverging away from each other in a direction towards one end of the channel-section such that the elongate channel is of a different, greater cross-sectional area at said one end, the diverging arms (3, 4) extending substantially parallel with each other in cross-section at said one end and forming an open mouth (11), the parallel orientation of the arms (3, 4) in cross-section at said one end of the channel-section preventing the fastener from gripping paper at said one end as paper is inserted into the open mouth (11) and thereby facilitating the introduction of paper into the fastener, the first arm (3) projecting beyond the second arm (4) at the end of the fastener provided with the open mouth (11), the projecting portion of the first arm forming a platform (10) upon which the edge of one or more sheets of paper is supported when the paper is to be inserted into the fastener.

14. A paper fastener comprising a generally channel-sectioned plastic molded component having a base (2) and first (3) and second (4) opposed arms between which an elongate channel is defined, the first and second arms (3, 4) having respective free edges which engage each other when the fastener is not in use, the base of the channel-section and part of at least one arm each have a substantially planar outer surface which provides a region adapted to be written upon, one of the opposed arms forming a supporting surface for the paper and the other arm serving as a gripping member which engages paper received within the channel-section between the opposed arms and biases the paper against the opposed arm, the inherent resilience of the plastics molding which forms the paper fastener permitting the arms (3, 4) to be moved apart slightly to permit paper to be introduced between the opposed arms while firmly gripping the paper, the first and second opposed arms (3, 4) having respective inwardly directed surfaces, the inwardly directed surface of the second arm (4) carrying an inwardly directed tooth (9) and the inwardly directed surface of the first arm (3) carrying one or more teeth or ridges (8), the teeth or ridges (8) being formed at that point on the first arm (3) which is engaged by the second arm (4) such that the tooth (9) formed on the inwardly directed surface of the second arm (4) engages with the teeth or ridges (8) formed on the inwardly directed surface of the first arm (3), the arms (3, 4) of the channel-sectioned fastener diverging away from each other in a direction towards one end of the channel-section such that the elongate channel is of a different, greater cross-sectional area at said one end, the diverging arms (3, 4) extending substantially parallel with each other in cross-section at said one end and forming an open mouth (11), the parallel orientation of the arms (3, 4) in cross-section at said one end of the channel-section preventing the fastener from gripping paper at said one end as paper is inserted into the open mouth (11) and thereby facilitating the introduction of paper into the fastener, the first arm (3) projecting beyond the second arm (4) at the end of the fastener provided with the open mouth (11), the projecting portion of the first arm (3) forming a platform (10) upon which the edge of one or more sheets of paper is supported when the paper is to be inserted into the fastener.

* * * * *